US006409297B1

(12) United States Patent
Morgan et al.

(10) Patent No.: US 6,409,297 B1
(45) Date of Patent: Jun. 25, 2002

(54) ALIGNMENT OF IMPRINTS

(75) Inventors: Christopher John Morgan, Stapleford; Ian Thompson-Bell, Bluntisham; William James Herring, Brentwood, all of (GB)

(73) Assignee: Neopost Limited, Essex (GB)

( * ) Notice: Subject to any disclaimer, the term of this patent is extended or adjusted under 35 U.S.C. 154(b) by 0 days.

(21) Appl. No.: 09/493,669

(22) Filed: Jan. 28, 2000

(30) Foreign Application Priority Data

Jan. 29, 1999 (GB) ..... 9902058

(51) Int. Cl.[7] ..... B41J 29/38; B41J 3/00
(52) U.S. Cl. ..... 347/12; 347/4
(58) Field of Search ..... 347/3, 12, 19; 400/323, 76, 83–90

(56) References Cited

U.S. PATENT DOCUMENTS 4,603,984 A 8/1986 Ullenboom ..... 400/121
5,038,153 A * 8/1991 Liechti et al. ..... 347/4

FOREIGN PATENT DOCUMENTS

GB 2 241 364 A 8/1991

* cited by examiner

*Primary Examiner*—John Barlow
*Assistant Examiner*—Alfred Dudding
(74) *Attorney, Agent, or Firm*—Shoemaker and Mattare

(57) ABSTRACT

A method of controlling operation of a print head to align imprints printed by the print head in two traverses in opposite directions is disclosed. The print head includes a row of printing elements that are operated selectively in a plurality of print cycles to print each imprint. Upon completion of printing a first imprint, signals corresponding to motion of the print head step the count of a counter. The stepping of the counter is terminated when the print head passes a reference position. During a reverse traverse of the print head, stepping of the counter is initiated when the print passes the reference position and operation of the print head to print a second imprint is initiated when the count reaches a predetermined count.

9 Claims, 2 Drawing Sheets

ALIGNMENT OF IMPRINTS

BACKGROUND OF THE INVENTION

This invention relates to imprints printed by a print head and to alignment of imprints printed in successive swathes by the print head one with another.

Digital print heads are known in which a plurality of print elements are disposed in a line and are actuated selectively in a succession of print cycles. Selective actuation of the print elements in a print cycle effects printing of dots in corresponding selected locations in a column on a print receiving medium. The print heads may be ink jet print heads in which droplets of ink are ejected selectively from a row of nozzles onto the print receiving medium.

The print head is transported relative to the print receiving medium in a direction perpendicular to the line of print elements so that the columns in which printing is effected in successive printing cycles are spaced in a direction perpendicular to the columns. One use for such print heads is in printers of postage meters where the printer is required to print postage indicia on mail items. In commonly available ink jet print heads, the extent of the row of nozzles is too short to print a postage indicium in a single pass of the print head. Accordingly it is proposed to cause the print head to traverse a print field of the mail item in a first direction in a first pass and to traverse the print field in an opposite direction in a second pass, the print head being displaced by a distance approximately equal to the length of the row of nozzles after the first pass so that in the first pass a first swathe of the indicium is printed and in the second pass a second swathe of the indicium, adjacent to the first part, is printed. -In order that the completed indicium is correctly printed without an interface between the first and second swathes being visible, it is necessary to ensure that the second swathe of the indicium is printed in alignment, in the direction of traverse of the print head, with the first swathe.

SUMMARY OF THE INVENTION

According to one aspect of the invention a method of alignment of a first imprint printed in a first traverse in a first direction along a first track by a print head having a plurality of selectively energisable printing elements disposed in a line with a second imprint printed in a second traverse in a second direction opposite to said first direction along a second track displaced relative to said first track includes the steps of generating signals corresponding to increments of traverse of the print head; during the first traverse of the print head initiating printing of a first imprint; upon completion of printing said first imprint initiating incrementing a counter from a first count by said signals; terminating incrementing the counter in response to sensing of the print head passing a reference position; and during the second traverse of the print head initiating decrementing of the counter by said signals in response to sensing of the print head passing the reference position; and in response to decrementing the counter to a second predetermined count initiating printing of the second imprint.

The first and second counts may be equal or the second count may be offset from the first count by a predetermined correction count.

According to a second aspect of the invention printing apparatus includes a print head having a plurality of selectively energisable printing elements disposed in a line; drive means to traverse the print head in a first traverse in a first direction along a first track and to traverse the print head in a second direction opposite to said first direction along a second track, said second track being displaced relative to the first track in a third direction transverse to said first and second directions; print head control means operable to selectively energise said printing elements during the first traverse of the print head to print a first imprint and to selectively energise said printing elements during the second traverse of the print head to print a second imprint adjacent said first imprint; a counter; the control means being operative during said first traverse to initiate stepping of the counter in correspondence with increments of traverse of the print head in the first direction upon completion of printing the first imprint and operative in response to sensing traversing of the print head past a reference location in the first traverse to terminate stepping of said counter and said control means being operative during said second traverse in response to sensing traversing of the print head past the reference location in the second traverse to initiate stepping of the counter in correspondence with increments of traverse of the print head in the second direction and to initiate energisation of the printing elements to print the second imprint in response to the counter being stepped to a predetermined second count.

BRIEF DESCRIPTION OF THE DRAWING

An embodiment of the invention will now be described hereinafter by way of example with reference to the drawings in which.

DESCRIPTION OF THE PREFERRED EMBODIMENT

Figure 1:
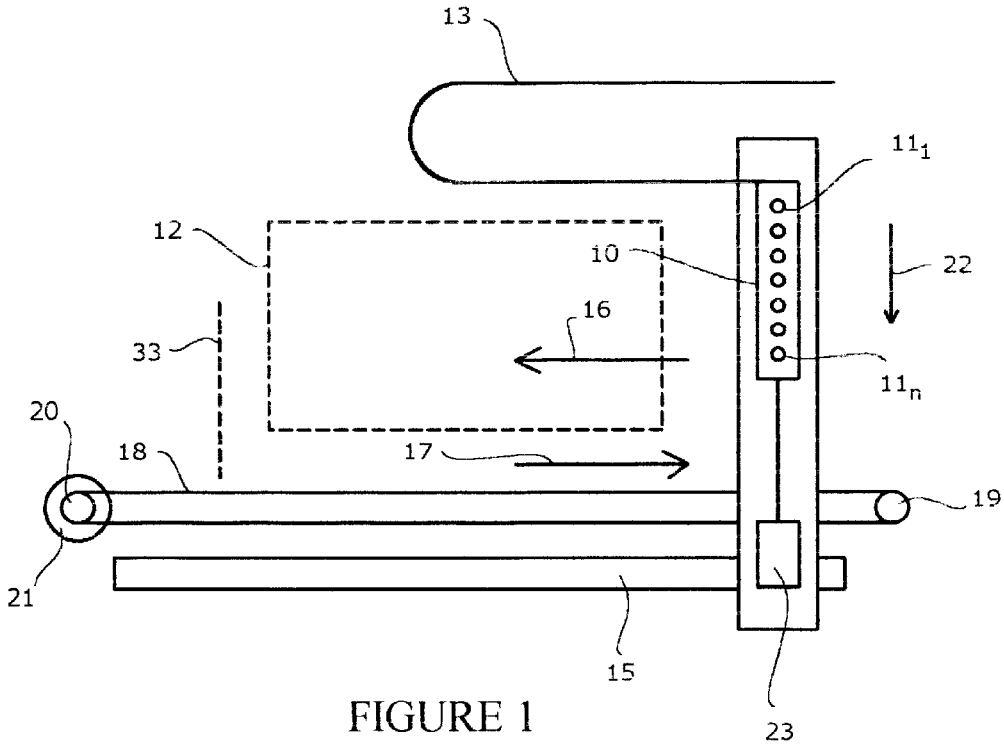
FIG. 1 diagrammatically illustrates a transport mechanism for a print head of a printer.

Referring first to FIG. 1 of the drawings, a print head 10 is mounted for traversal in directions transverse to a line of nozzles $\mathbf{11}_l$–$\mathbf{11}_n$. In addition the print head is mounted for displacement from a first index position to a second index position in a direction aligned with the line of nozzles whereby the print head may be utilised to print an imprint in two swathes which is of greater extent than the length of the line of nozzles. The traversal and displacement of the print head may be effected by a transport mechanism as follows. The print head 10 is carried on a carriage 14. The print head and carriage are shown in FIG. 1 located at a parked position prior to a printing operation. The carriage 14 is traversable along a guide rod 15 in a first direction indicated by arrow 16 from the parked position across a print field 12 and in a second direction, opposite to the first direction, indicated by arrow 17 back across the print field to the parked position. Traversal of the carriage is effected by drive means which may comprise a belt 18 passing around an idler pulley 19 and a pulley 20 driven by a drive motor 21, the belt being secured to the carriage 14. In addition to traversal of the print head in the directions of arrows 16, 17, the print head is mounted on the carriage such that the print head can be displaced in a direction, indicated by arrow 22, transverse to the directions of arrows 16, 17 from the first index position (as shown in FIG. 1) to the second index position. An indexing mechanism 23 carried on the carriage 14 and mechanically coupled to the print head 10 is operated to cause the print head to be displaced in the direction of arrow 22 by a distance which is slightly less than the extent of the line of nozzles $11_1$–$11_n$. The indexing mechanism may be operated by the traversal of the print head carriage. During traverse of the carriage in the direction of arrow 16 the print head is located in the first index position and during traverse of the print head carriage in an opposite direction, in the direction of the arrow 17, the print head is located in a displaced second index position relative to the first index position. A mechanism for traversal of the print head and displacement of the print head from a first index position to a second index position is the subject of our GB patent application 9818026.8 filed Aug. 18, 1998.

The ink jet print head may be a bubble ink jet print head in which ink is ejected from the nozzles by passage of electric current through a resistive element corresponding to the nozzle. Bubble ink jet print heads and other forms of digital print heads are well known and it is believed to be unnecessary for the purposes of an understanding of this invention to provide a detailed explanation of the construction and operation of the print heads. It is sufficient to understand that the print elements are disposed in a line and are selectively operable to deposit dots of ink on a print receiving medium. For clarity the print head is shown with only a relatively small number of nozzles. However it will be appreciated that in practice a much higher number of nozzles are provided. For example in a print head having a print height of ½ inch (12 cm) approximately 300 nozzles and corresponding resistive elements are provided.

When it is desired to print dots in desired selected positions in a column, print control signals cause operation of selected ones of the nozzles $11_1$–$11_n$. The groups of the resistive elements for operation of the nozzles conveniently are connected in banks and operation of selected nozzles comprises selection of a bank and selection of nozzles with the selected bank. The print control signals are generated in a series of printing cycles while the print head 10 is traversed by the print head transport mechanism relative to a print receiving medium across the print field thereby producing an imprint of a desired pattern in a column by column manner.

Figure 2:
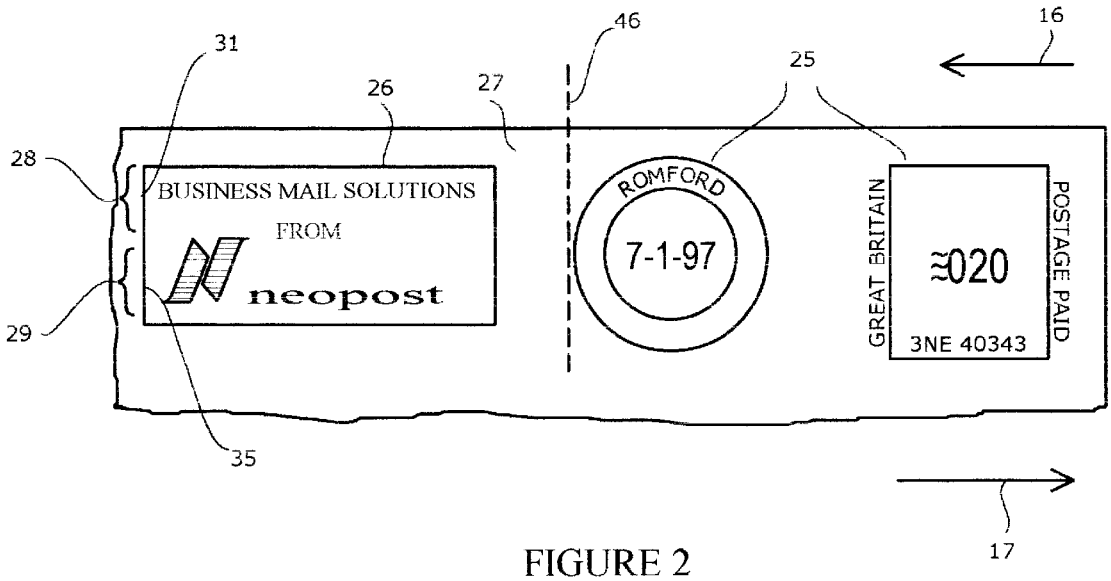
FIG. 2 illustrates printing of a postage indicium and slogan in two print swathes.

Referring to FIG. 2, a typical postage indicium 25 and slogan 26 of a format currently printed by postage meters on mail items 27 to indicate that postage has been accounted for is illustrated as comprising first and second swathes 28, 29. For reasons of explanation and clarity in the drawing, in FIG. 2 the two swathes 28 and 29 forming the indicium are shown separated with a gap therebetween. However in practice the two swathes are printed relative to one another such that substantially there is no gap and no overlap between the two swathes.

In a first traverse by the print head in the direction indicated by arrow 16, the swathe 28 comprising an upper half of the indicium and slogan is printed in the print field. In a second traverse by the print head in an opposite direction indicated by arrow 17, after the print head has been displaced by the index mechanism, the swathe 29 comprising a lower half of the indicium and slogan is printed in the print field. A method of controlling operation of the print head so that there is no gap and no overlap between the printed swathes is described in our pending application GB 9802127.2.

It will be appreciated that, in order that there is no distortion of the completed imprint in a region where the two swathes of the imprint adjoin, the two swathes of the imprint must be aligned in a horizontal direction, i.e. in a direction parallel to the traverses in directions 16, 17 of the print head.

Figure 3:
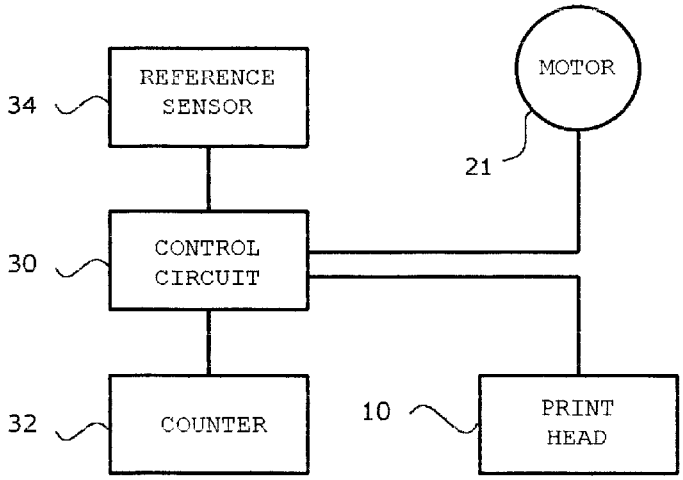
FIG. 3 is a block diagram of electronic circuits controlling operation of the printer.

Referring now to FIG. 3, a control circuit 30 outputs drive pulses to the drive motor 21. The drive motor is a stepper motor and hence the drive motor moves the print head through an incremental distance in response to each drive pulse. The control circuit also outputs print signals via a flexible ribbon cable 13 to the print head to cause operation of selected nozzles of the print head. It will be appreciated that each drive pulse represent an increment of movement of the print head. Accordingly the operation of the print head is timed relative to the drive pulses so that after the print head is moved from the parked position and is traversed across the print field, i.e an area of the mail item to receive an imprint, the print head is operated in a succession of print cycles to eject ink from selected nozzles to print dots in uniformly spaced columns and thereby print the first swathe 28 of the indicium. As shown in FIG. 2, the swathe 28 is printed in the direction 16 from right to left. Hence the final cycle of operation of the print head in printing the first swathe 28 is that cycle in which the leftmost end, a vertical line 31 in the example shown in FIG. 2, of the imprint is printed. A counter 32 is controlled by the control circuit 30. Upon occurrence of the final printing cycle of the print head in printing the first swathe, the control circuit initiates application of the drive pulses to the counter 32 to increment the counter from zero.

A reference position for the print head is located at a position beyond the print field 12 in the direction 16 and is indicated by reference numeral 33 in FIG. 1. A sensor 34 is provided to provide an output when the print head is located at the reference position and is connected to the control circuit 30.

When the print head is being traversed in the direction of arrow 16, has passed beyond the print field 12 and reaches the reference position 33, the control circuit terminates incrementing of the counter 32. The print head then continues to be moved to an end of its traverse remote from the park position. The direction of movement of the print head is then reversed so as to traverse in the direction of arrow 17 and the print head is displaced from the first index position to the second index position. When the print head reaches the reference position 33, the control circuit initiates application of the drive pulses to decrement the counter 32. The control circuit is responsive to the count of the counter 32 being decremented to zero to initiate a succession of printing cycles in which the print head is operated selectively to print dots in uniformly spaced columns as required to print the second swathe 29 of the indicium. It will be appreciated that the second swathe is printed from left to right in the direction of arrow 17 and hence in the first cycle of operation of the print head the leftmost end of the imprint, a vertical line 35 in the example shown in FIG. 2, of the second swathe 29 is printed.

It will be appreciated that the content of the counter 32 at the end of the first traverse in the direction 16 represents a distance traversed by the print head from the end of the imprint of the first swathe to the reference position. The decrementing of the counter to zero during the traverse of the print head in the reverse direction 17 indicates that the print head has traversed from the reference position by the distance represented by the count in the counter at the end of the first traverse. Accordingly, during the reverse traverse, when the count is decremented to zero the print head is positioned in a location aligned with the end of the imprint of the first swathe and by initiating operation of the print head at this location, the start of the imprint of the second swathe is precisely aligned with the end of the imprint of the first swathe. Hence the leftmost end of the imprint printed in the first and second swathes is printed in horizontal alignment, i.e. alignment in the direction of arrows 16, 17, and therefore the second swathe of printing is aligned with the first swathe of printing. The slogan 26 is optionally printed and hence the imprint may comprise only the postage indicium 25. As a result even if the postage indicium is always of the same length of imprint, the overall length of the imprint varies in dependence upon whether or not the slogan is printed and, if the slogan may be of selected variable length, may also depend upon the length of the required slogan. It will be appreciated that the method of ensuring alignment of the second swathe of printing with the first swathe of printing described hereinbefore is not dependent upon the length of the imprint. If a slogan is included in the imprint, the count in the counter represents a distance from the left hand end of the slogan and decrementing of the counter in the reverse traverse indicates that the print head is positioned to start printing of the left hand end of the slogan in the second swathe. Similarly, if a slogan is not included in the imprint, the count in the counter represents a distance from the left hand end 46 of the postage indicium and decrementing of the counter in the reverse traverse indicates that the print head is positioned to start printing of the left hand end 46 of the postage indicium in the second swathe.

Figure 4:
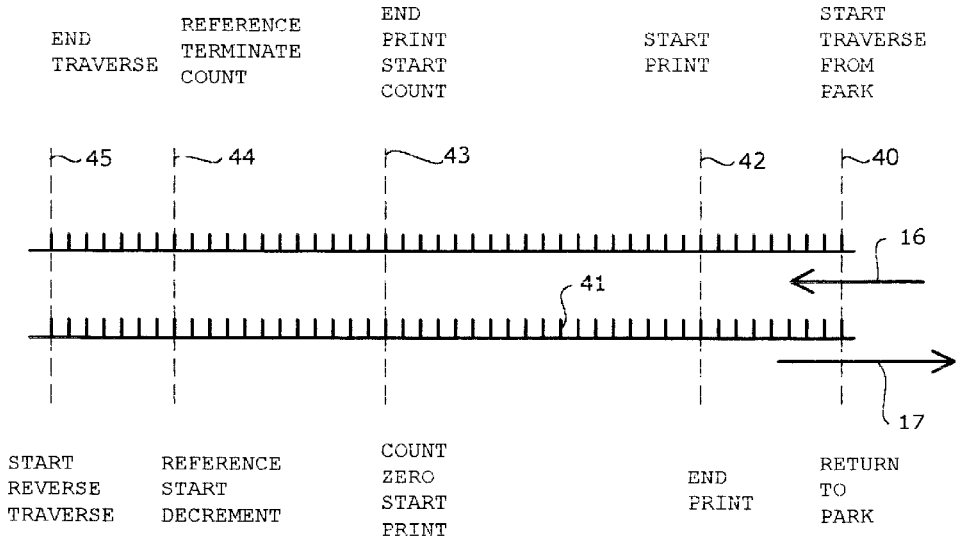
FIG. 4 illustrates operational states of the printer relative to drive pulses.

FIG. 4 illustrates the operations of the printer during printing of an imprint in two swathes. Initially the print head is in a park position 40. Drive pulses 41 applied to the drive motor cause the print head to be accelerated and to reach a uniform speed traverse at a start print position 42 at which the control circuits initiates printing of the first swathe of imprint. At the finish of printing 43 of the first swathe, the control circuit initiates incrementing of the counter. When the print head reaches the reference position 44, the control circuit terminates incrementing of the counter. The traverse of the print head then decelerates to an end limit position 45. The drive motor is then driven in reverse in direction of arrow 17 and the print head is accelerated to reach a uniform traverse speed. When the print head reaches the reference position, the control circuit initiates decrementing of the counter. When the counter is decremented to zero, the control circuit initiates printing of the second swathe of the imprint. finally toward the end of the traverse of the print head, the print head is decelerated and comes to rest at the park position.

It is to be understood the train of pulses used to control operation of the print relative to the traversing movement of the print head and the train of pulses used to increment and decrement the counter need not be the train of drive pulses provided that there is a fixed timed relationship therebetween and for example the repetition rate of one train of pulses may be a multiple or sub-multiple of another one of the trains of pulses. Also the train of pulses may be generated by sensing movement of the print head during traverses thereof, the pulses corresponding to increments of movement of the print head.

If desired instead of incrementing the counter from zero, the counter may be incremented from a predetermined initial count and then decremented to that predetermined count. Furthermore, in order to correct for backlash in the mechanical part of the print head transport mechanism or hysteresis in the electronic control system, the counter may be decremented to a count which is offset by a predetermined amount from the initial count.

The sensor 34 may be responsive to presence of the print head or print head carriage at the reference position or the sensor may be operated by other means, for example a tachometer disc, driven by the drive motor.

It is to be understood that instead of traversing and indexing the print head relative to the print receiving medium, one or both of these relative movements may be effected by traversing or indexing the print receiving medium relative to the print head.

The print head is described hereinbefore as including resistive elements energisable to effect ejection of ink from the nozzles. It is to be understood that the print head may be provided with other means, for example piezoelectric elements operable to effect ejection of ink.

We claim:

1. A method of relative alignment of a first imprint printed in a first traverse in a first direction along a first track by a print head and a second imprint printed in a second traverse in a second direction opposite to said first direction along a second track displaced relative to said first track; said print head including a plurality of selectively energisable printing elements disposed in a line; includes the steps of generating signals corresponding to increments of traverse of the print head; during the first traverse of the print head initiating printing of a first imprint; upon completion of printing said first imprint initiating stepping of a counter from a first count by said signals; terminating stepping of the counter in response to sensing of the print head passing a reference position in said first traverse; and during the second traverse of the print head initiating stepping of the counter by said signals in response to sensing of the print head passing the reference position in said second traverse; and in response to stepping of the counter to a second predetermined count initiating printing of the second imprint.

2. A method as claimed in claim 1 wherein the second count is equal to the first count.

3. A method as claimed in claim 2 wherein the counter is incremented during the first traverse and is decremented during the second traverse.

4. A method as claimed in claim 2 wherein the first count is zero.

5. A method as claimed in claim 1 wherein the second count is offset from the first count by a predetermined correction count.

6. A method as claimed in claim 5 wherein the predetermined correction count provides a correction for backlash in a mechanical drive to traverse the print head in the first and second directions.

7. A method as claimed in claim 5 wherein the predetermined correction count provides a correction for hysteresis in electrical control of energisation of the printing elements.

8. Printing apparatus including a print head having a plurality of selectively energisable printing elements disposed in a line; drive means to traverse the print head in a first traverse in a first direction along a first track and to traverse the print head in a second direction opposite to said first direction along a second track, said second track being displaced relative to the first track in a third direction transverse to said first and second directions; print head control means operable to selectively energise said printing elements during the first traverse of the print head to print a first imprint and to selectively energise said printing elements during the second traverse of the print head to print a second imprint adjacent said first imprint; a counter; the control means being operative during said first traverse to initiate stepping of the counter in correspondence with increments of traverse of the print head in the first direction upon completion of printing the first imprint and operative in response to sensing traversing of the print head past a reference location in the first traverse to terminate stepping of said counter and said control means being operative during said second traverse in response to sensing traversing of the print head past the reference location in the second traverse to initiate stepping of the counter in correspondence with increments of traverse of the print head in the second direction and to initiate energisation of the printing elements to print the second imprint in response to the counter being stepped to a predetermined second count.

9. Printing apparatus as claimed in claim 8 wherein the counter is incremented by the control means during the first traverse and the counter is decremented by the control means in the second traverse.

* * * * *